United States Patent [19]

Pergeau

[11] Patent Number: 4,538,813

[45] Date of Patent: Sep. 3, 1985

[54] CARD HOLDER

[76] Inventor: Raymond J. Pergeau, 17624 N. 38th Ave., Glendale, Ariz. 85308

[21] Appl. No.: 578,962

[22] Filed: Feb. 10, 1983

[51] Int. Cl.[3] ..... A63F 1/10

[52] U.S. Cl. ..... 273/150; 40/124.4

[58] Field of Search ..... 273/150; 40/124, 124.4; 248/153, 441 D

[56] References Cited

U.S. PATENT DOCUMENTS

| | | | |
|---|---|---|---|
| 1,629,070 | 5/1927 | Cox | 273/150 |
| 1,955,340 | 4/1934 | McPherson | 273/150 |
| 2,520,490 | 8/1950 | Boward | 273/150 |
| 4,346,895 | 8/1982 | Brownlee | 273/150 |

FOREIGN PATENT DOCUMENTS

| | | | |
|---|---|---|---|
| 81241 | 7/1914 | Austria | 273/150 |
| 1516522 | 7/1949 | Austria | 273/150 |
| 449499 | 12/1912 | France | 273/150 |

*Primary Examiner*—Anton O. Oechsle

*Attorney, Agent, or Firm*—Don J. Flickinger

[57] ABSTRACT

An apparatus for holding and securing a plurality of playing cards includes a base, first and second side members coupled to opposite ends of the base and extending upwardly therefrom, and card retention means supported above the base by the first and second side members for engaging and securing the playing cards continuously along the front and back surfaces thereof. The card retention means includes a longitudinal groove in the upper surface of the base between the first and second side members, a first dowel coupled between the side members above the surface of the base in approximate alignment with the groove, a second dowel coupled between the side members above the first dowel and to the rear thereof, and a third dowel coupled between the side members below and behind the second dowel and spaced therefrom so as to permit a plurality of overlapped cards to pass therebetween. The side members are of sufficient size so as to conceal the faces of the playing cards held in the device from an opponent's view.

8 Claims, 3 Drawing Figures

CARD HOLDER

FIELD OF THE INVENTION

This invention relates generally to playing card holders and, more particularly, to a playing card holder utilizing elongate parallel members for gripping the cards and including means for obscuring the faces of the cards from the view of opponents.

PRIOR ART

Card holders for holding "dummy" hands are well known. Exemplary are the devices shown and described in U.S. Pat. Nos. 826,783 and 840,549. Sometimes card holders are utilized by players to achieve a greater degree of freedom which permits them to enjoy a snack, smoke, leave the table, etc. Such an apparatus is shown and described in U.S. Pat. No. 3,891,220.

As should be obvious, the handling of playing cards is extremely difficult for people suffering from certain disabilities such as rheumatism, arthritis, etc. not to mention individuals with only a single hand. Of the above three cited patents, only U.S. Pat. No. 840,459 describes an apparatus which sufficiently secures the playing cards to the extent required by handicapped players of the above described types. This device, however, suffers from the disadvantages that (1) no means are provided for concealing the cards from the player's opponents; and (2) the card securing apparatus does not provide uniform securing pressure on the cards. This imparts a twisting tendency on some of the cards depending upon their position in the holder.

It would be highly advantageous, therefore, to remedy the foregoing and other deficiencies inherent in the prior art.

Accordingly, it is an object of the present invention to provide an improved card holding apparatus.

It is a further object of the present invention to provide a card holding apparatus including means for concealing the face of the cards held hereon from an opponent's view.

It is a still further object of the present invention to provide a card holder apparatus which supplies a uniform securing pressure across the faces of the cards held thereon.

SUMMARY OF THE INVENTION

According to a broad aspect of the invention, there is provided an apparatus for holding a plurality of playing cards of the type having a back surface and a front surface, said front surface having visible indicia thereon, and for displaying said cards in a visually discernible and selectively individually retrievable array, said apparatus comprising a base having an upper surface; and card retention means supported above said base for engaging and securing said cards continuously across the front and back surfaces thereof.

DETAILED DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENT

Figure 2:
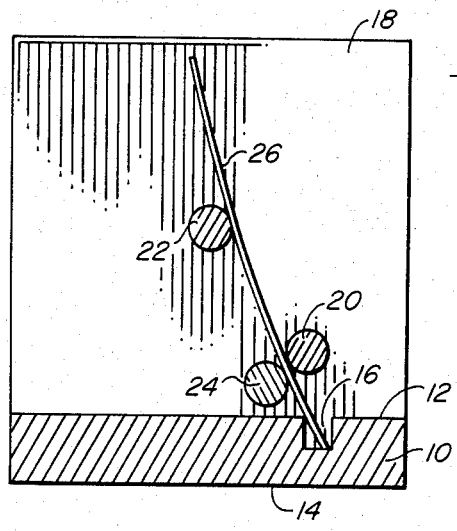
FIG. 2 is a cross-sectional view of the apparatus shown in FIG. 1 taken along line 2—2.
Figure 1:
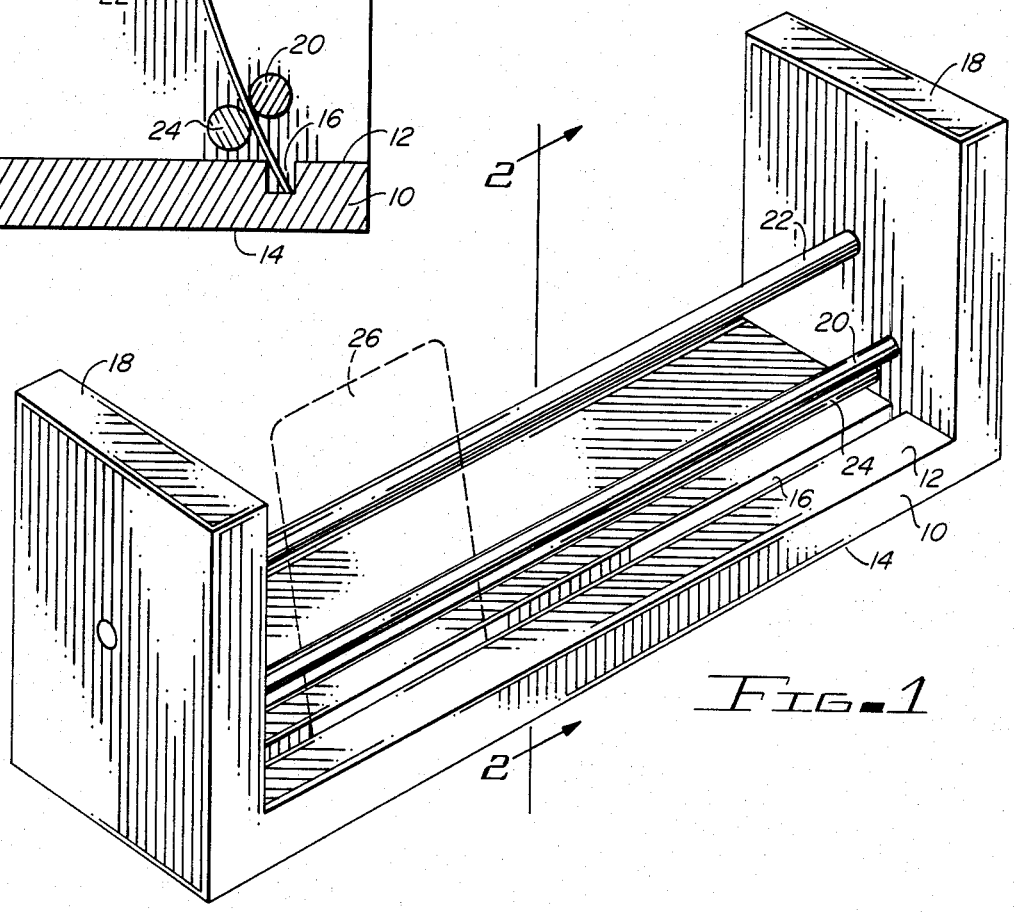
FIG. 1 is an isometric view of the inventive card holding apparatus.
Figure 3:
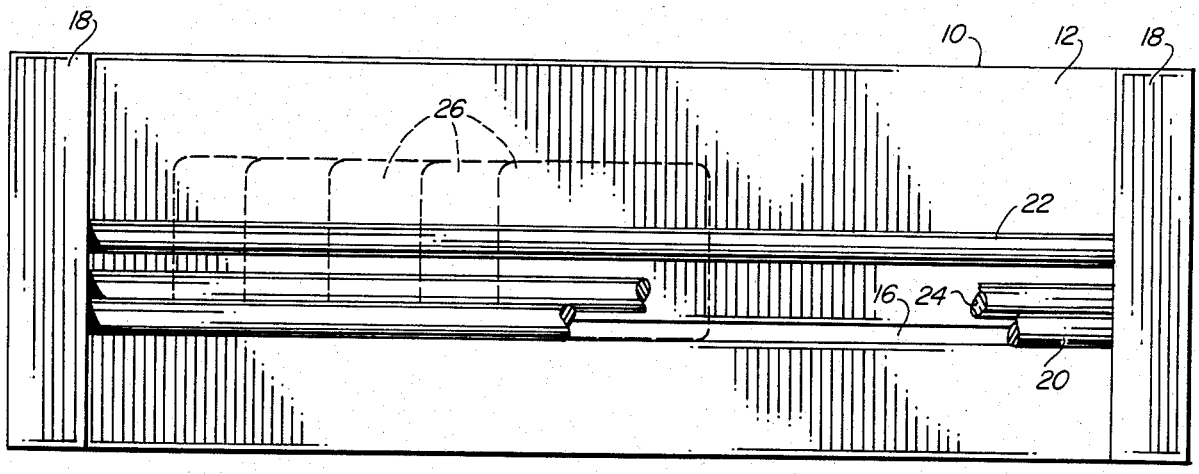
FIG. 3 is a top, partial cut away view of the apparatus shown in FIG. 1.

As is shown in FIGS. 1, 2 and 3, the inventive card holding apparatus includes a base 10 having upper surface 12 and a lower surface 14. The base 10 is shown as being generally rectangular in shape and is provided with a longitudinal groove 16 in upper surface 12. Coupled to opposite ends of base 10 are first and second upright side panels 18 (also rectangular in shape). Base 10 is chosen to be of a sufficient size and weight so as to provide a stable card holding apparatus which need not be held. Thus, handicapped players such as those suffering from rheumatism or arthritis may use both hands to manipulate the playing cards. If necessary, base 10 may be weighted (e.g., lead filled) in order to provide the necessary stability. Side members 18 are chosen to be of sufficient height and width so as to conceal the faces of the cards held by the apparatus from a player's opponents. Base 10 and side members 18 are preferably made of plastic although any material which offers the required strength and rigidity may be utilized.

Coupled to side members 18 and extending therebetween above said base 10 are first, second and third elongate members 20, 22 and 24, respectively, (e.g. dowels). Dowel 20 is positioned above base 10 and is in approximate alignment with groove 16. Dowel 22 is parallel to dowel 20 and is positioned above and to the rear thereof. Dowel 24 is parallel to dowels 20 and 22 and is positioned slightly below and to the rear of dowel 20 such that the space between dowels 20 and 24 is sufficient to receive approximately three overlapped playing cards.

Playing cards 26 are shown in solid form in FIG. 2 and by dotted lines in FIGS. 1 and 3. As can be seen, groove 16 receives the lower edge of playing card 26. The upper portion of playing card 26 rests on dowel 22 while the intermediate section of playing card 26 is received and frictionally secured by dowels 20 and 24. The length of positions of groove 16 and dowels 20 and 22 are related such that a slight bend is imparted to card 26 thus enhancing the degree to which the card is secured in the holder.

It is to be noted that as long as the bottom edge of the card is positioned within groove 16, the role of dowel 24 is minimized since the card is secured continuously along its front face dowel 20 and along its rear face by dowel 22. However, the card may be adequately secured without groove 16 by dowels 20, 22 and 24 alone.

The inventive card holding apparatus shown in FIGS. 1, 2 and 3 has distinct advantages over the known prior art. First, the playing cards are gripped continuously along their surfaces by parallel elongate members. This enhances the degree to which the cards are secured and also prevents twisting. Second, end panels are provided for concealing the faces of the playing cards from the player's opponents.

The above description is given by way of example only. Changes in form and details may be made by one skilled in the art without departing from the scope of the invention as defined by the appended claims.

Having fully described and disclosed the present invention in such clear and concise terms as to enable those skilled in the art to understand and practice the same, the invention claimed is:

1. An apparatus for holding a plurality of playing cards of the type having a back surface and a front surface, said front surface having visible indicia thereon, and for displaying said cards in a visually discernible and selectively individually retrievable array, said apparatus comprising:

a base having an upper surface;

first and second side members coupled to opposite ends of said base and extending upwardly therefrom;

a first elongate member coupled between said first and second side members above said surface;

a second elongate member coupled between said first and second side members above said first elongate member and to the rear thereof; and a third elongate member coupled between said first and second side members and positioned slightly below and to the rear of said first elongate member, said third elongate member being spaced from said first elongate member so as to permit a plurality of overlapping playing cards to pass between said first and third elongate members, said first elongate member for engaging an intermediate portion of said playing card along the front surface thereof, and said second elongate member for engaging an upper portion of said playing card along a back surface thereof.

2. An apparatus according to claim 1 wherein said base and said first and second side members are rectangular in shape.

3. An apperatus according to claim 1 further comprising a longitudinal groove in said upper surface between said first and second side members, said first and third elongate members guiding a lower edge of a playing card into said groove.

4. An apparatus according to claim 1 wherein said side members are of sufficient size so as to conceal the faces of the cards positioned on the holder from an opponent's view.

5. An apparatus according to claim 1 wherein said base has a bottom for resting on a selected surface.

6. An apparatus according to claim 5 wherein said base is weighted for stability.

7. An apparatus according to claim 1 wherein said first, second and third elongate members are dowels.

8. An apparatus according to claim 1 wherein said first, second and third elongate members are positioned with respect to each other such that the playing cards being secured thereby are caused to bend.

* * * * *